US009297110B2

(12) United States Patent
Mocker et al.

(10) Patent No.: US 9,297,110 B2
(45) Date of Patent: Mar. 29, 2016

(54) METHOD FOR SORTING LAUNDRY ITEMS, IN PARTICULAR DIRTY LAUNDRY ITEMS

(71) Applicant: Herbert Kannegiesser GmbH, Vlotho (DE)

(72) Inventors: Jurgen Mocker, Herford (DE); Dirk Littmann, Bad Salzuflen (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 112 days.

(21) Appl. No.: 14/229,451

(22) Filed: Mar. 28, 2014

(65) Prior Publication Data

US 2014/0303771 A1 Oct. 9, 2014

(30) Foreign Application Priority Data

Apr. 9, 2013 (DE) ..... 10 2013 005 969

(51) Int. Cl.
*G06F 7/00* (2006.01)
*D06F 93/00* (2006.01)

(52) U.S. Cl.
CPC ..... *D06F 93/00* (2013.01)

(58) Field of Classification Search
None
See application file for complete search history.

(56) References Cited

U.S. PATENT DOCUMENTS 3,550,772 A * 12/1970 Melvin ..... D06F 93/00 209/705
2008/0116274 A1* 5/2008 Aldridge ..... D06F 93/00 235/440

FOREIGN PATENT DOCUMENTS

| | | | | |
|---|---|---|---|---|
| DE | 10149910 A1 | | 4/2003 | |
| DE | EP 2113606 A2 | * | 11/2009 | ..... D06F 93/00 |
| DE | EP 2128329 A2 | * | 12/2009 | ..... B07C 5/3412 |
| EP | 2113606 A2 | | 11/2009 | |
| EP | 2128329 A2 | | 12/2009 | |
| GB | 2079708 A | | 1/1982 | |

OTHER PUBLICATIONS

European Patent Office, Europaischer Recherchenbericht (patent search on priority application), Jul. 1, 2014.

* cited by examiner

*Primary Examiner* — Yolanda Cumbess
(74) *Attorney, Agent, or Firm* — Laurence P. Colton; Smith Tempel Blaha LLC

(57) ABSTRACT

A method for storing scanned information concerning a relevant laundry item in a data storage means which is assigned to a carrier holding the laundry item. The laundry item is assigned to a storage means or an intermediate storage means with the carrier comprising its information by a conveying system. The laundry items are sorted by way of their individual information stored on the carriers, moved into corresponding storage sections of the storage means and at the same time are both sorted and formed into laundry batches. The laundry batch then includes laundry items which require a same treatment. The laundry batch can then be supplied, for example, to a continuous-batch washing machine where the laundry items of the laundry batch are washed and, where applicable, subject to further treatments in the manner predefined according to their information. The sorting of the laundry items is automated to a large extent.

23 Claims, 3 Drawing Sheets

METHOD FOR SORTING LAUNDRY ITEMS, IN PARTICULAR DIRTY LAUNDRY ITEMS

STATEMENT OF RELATED APPLICATIONS

This patent application claims the benefit of German Patent Application No. 10 2013 005 969.0 having a filing date of 9 Apr. 2013.

BACKGROUND OF THE INVENTION

1. Technical Field

The invention relates to a method for sorting laundry items, in particular dirty laundry items, wherein the laundry items are suspended on a conveying system, are conveyed by the conveying system to at least one sorting device and are sorted in the sorting device by way of information concerning the respective laundry item. In addition, the invention relates to a method for sorting laundry items, in particular dirty laundry items, wherein the laundry items are conveyed by a conveying system sorted in storage sections to a sorting device by laundry items which meet the same sorting criteria being conveyed into the same storage section.

2. Prior Art

Laundry items, in particular dirty laundry items to be washed or finished, are sorted after delivery in a laundry so that they can be washed, finished or treated in some other way in a targeted manner.

The sorting is effected by way of information which the respective laundry items comprise. For example, said information is contained in bar codes which are carried by the respective laundry item. The information is read manually by an operator using a read device, for example a bar code reader, and is displayed to said operator. The operator then sorts the laundry items by way of the information displayed to him. This is expensive in terms of labour and time.

BRIEF SUMMARY OF THE INVENTION

The object underlying the invention is to create a method for sorting laundry items, in particular dirty laundry items, which is automated at least for the most part.

A first method for achieving said object is a method for sorting laundry items, in particular dirty laundry items, wherein the laundry items are suspended on a conveying system, are conveyed by the conveying system to at least one sorting device and are sorted in the sorting device by way of information concerning the respective laundry item, characterized in that each laundry item is suspended on a carrier assigned to the conveying system, the information concerning the laundry item is transmitted to a storage means assigned to the carrier and the laundry item with the carrier assigned to it with the information concerning the laundry item hanging on the carrier is conveyed by the conveying system to and/or through at least the sorting device. According to this it is provided to assign each laundry item a carrier which comprises a storage means to which the information belonging to the laundry items is transmitted. Each laundry item is then conveyed with the carrier assigned to it and the information stored thereon by the conveying system to and/or through the sorting device. The sorting device then performs the sorting automatically by way of the information assigned to the carrier. The necessary information can be read from the carrier at any time and be evaluated for sorting. Information is readable when required in the carrier or on the carrier over the entire conveying path of the carriers with the laundry items hanging thereon.

In a preferred manner, it is provided to read the information from the laundry item, for example from the bar code carrier assigned to said laundry item, preferably by scanning manually. To this end, the laundry items are placed such that the information can be read manually from the same. Each laundry item is then hung on a carrier which is assigned to it. These are the only manual actions which are necessary according to the method according to the invention for sorting the laundry items, in particular dirty laundry items. Everything else occurs automatically by the information that has been read off or scanned manually from the respective laundry item being transmitted to a storage means of the relevant carrier and stored there. The information is stored in the storage means of that carrier to which the laundry item, from which the information originates, is assigned. Said information can be read off the carrier automatically at any time in a targeted manner such that the information is available everywhere along the entire conveying path of the laundry items where the information is required, in particular is called up. In this way the entire conveying path or also sorting operation of each individual laundry item can be tracked preferably in a continuous manner.

For example, information concerning the customer, the weight, the wash program and/or possible special treatments of the laundry item assigned to the carrier can be deposited in the storage means of the respective carrier. The wash program is important above all so that the laundry items which have to be washed using the same wash program or require the same finishing treatment, can be combined as a result of sorting to form a batch. Laundry items requiring special treatments, for example delicate laundry items, can also be sorted in a targeted manner by way of the data stored on the carrier. By way of the weight of the respective laundry item, a laundry batch of laundry items comprising the same sorting criteria with a certain weight can be formed. Details on the customer to whom the respective laundry item belongs can be used to define in a customer-related manner the treatment of the laundry items of a respective customer. However, the invention is not restricted to the named information. Further information which can be helpful to the sorting and/or the targeted treatment of the respective laundry item can be deposited in the storage means of the respective carrier.

A further preferred development of the method provides that by way of the information in the storage means of the carrier, the laundry item hanging thereon, from which the information concerning the carrier originates, is conveyed together with the carrier through the sorting device and/or is sorted. This allows for targeted control of the sorting operation, the carrier serving at the same time as conveying means or a type of conveying hanger or clamp, with which the respective laundry item can be conveyed along the conveying section of the conveying system and preferably also through the sorting device, in particular a storage system for forming at least part of the sorting device.

According to an advantageous further development of the method, batches of several laundry items are formed by the sorting device or in the sorting device by way of the information deposited in the storage means of the respective carrier. Such batches are preferably formed and the laundry items are correspondingly sorted in batches which are to experience the same treatment, preferably the same wash program or the same finishing treatment. The laundry items are thus combined in a sorted manner to form the respective batch in order then to be able to be washed or finished in batches in the manner provided for the respective laundry item.

According to another advantageous development of the method, the laundry items are supplied to a treatment device from the sorting device in batches on their carriers with the information concerning the laundry item which is hanging thereon. It is preferably provided that upstream of the treatment device a check is carried out by way of the information in the storage means of the carrier of the respective laundry item as to whether said laundry item really belongs to the relevant batch, that is whether it has been correctly sorted. The information concerning the carriers can thus also be used for control purposes.

A further advantageous development of the method provides that the laundry items are initially separated from their carriers directly upstream of the treatment. The laundry items are then treated correspondingly, for example washed or finished, without the carriers. Empty carriers are conveyed back to receive a next laundry item and the information concerning the previous laundry item in the data storage means of the respective carrier is erased or is overwritten with information concerning the next laundry item to be hung on the carrier. In this manner, it is possible to reuse the carriers to be conveyed, for example, in the circuit, the information concerning the laundry item hanging thereon at that time always being contained in the storage means of the respective carrier.

In a preferred manner, the method can be developed further in such a manner that the laundry items hanging down from the carrier are moved past a control station by the conveying system. At the control station, each laundry item hanging on a carrier can then be automatically inspected, for example by scanning for faults or damage and/or foreign bodies. The scanning can be effected by image-generating methods, in particular when damage such as holes or the like are to be determined, but also in a sensory manner looking for metal foreign bodies with, for example, magnets.

A second method for achieving the object, it being possible for it also to be a preferred further development of individual or several claims of the method described beforehand, comprises the a method for sorting laundry items, in particular dirty laundry items, wherein the laundry items are conveyed by a conveying system sorted in storage sections to a sorting device by laundry items which meet the same sorting criteria being conveyed into the same storage section, characterized in that laundry items which do not meet any sorting criteria of the sorting sections are initially intermediately stored. Said method provides that laundry items which do not meet any sorting criteria assigned at that moment to storage paths of a laundry storage means serving for sorting, are initially intermediately stored. As a result, the number of storage paths can be smaller than the number of possible sorting criteria. In particular, laundry items with a rarely occurring sorting criterion are initially intermediately stored. As soon as at least one storage path serving as a sorting section is free, a sorting criterion, to which at least one laundry item in the intermediate storage means corresponds, is assigned to said storage path and each laundry item meeting the sorting criterion assigned temporarily to said storage path is supplied out of the intermediate storage means to said storage path or sorting section. In this way, the number of sorting sections can be reduced or it is possible with a certain number of sorting sections to sort laundry items which comprise a larger number of different sorting criteria than there are sorting or storage sections present.

In addition, the invention provides that a certain type of treatment, for example the wash program with which the batch of several laundry items formed in the respective storage section is to be washed, is assigned to each sorting or storage section preferably in a temporary manner. A laundry batch for the respective type of treatment can be formed in each storage section. When the storage section is empty, a different type of treatment can be assigned to it, preferably a type of treatment which at least one laundry item in the intermediate storage means meets. Said method of operation makes it possible to form laundry batches for different types of treatment one after another with the same sorting or storage section. The laundry item storage means used for sorting consequently does not need to comprise sorting and storage sections for all conceivable types of treatment. A same storage section can be used to form batches of laundry items of different types of treatment one after another.

According to another advantageous further development of the method, the weight of all the laundry items is determined during sorting, preferably in the respective sorting or storage section. In this way, a laundry batch which comprises a certain overall weight and for example laundry items sorted according to the respective type of treatment can be formed in each storage section of the storage means.

The weight of all of the laundry items in the respective storage section is preferably determined by the weight of the respective laundry item stored in the carrier being accumulated up when the laundry items are assigned in a sorted manner to the corresponding storage section. In this case, as soon as an accumulated overall weight of the laundry items situated in the storage section at that time is produced, the laundry batch is complete. All the laundry items forming the respective laundry batch with the certain weight can then be moved out of the respective storage section and conveyed to the treatment device or can be collected initially in a receiving container, for example a laundry sack, for all the laundry batches.

BRIEF DESCRIPTION OF THE DRAWINGS

Preferred exemplary embodiments of the invention are explained in more detail below by way of the drawing, in which.

DETAILED DESCRIPTION OF PREFERRED EMBODIMENTS

The apparatuses shown represent a sorting and storage system by sorting and storing laundry items 10, in a preferred manner these being dirty laundry items, and supplying them in a sorted manner to a treatment downstream. Said treatment can be washing, finishing, chemical cleaning or similar. The laundry items 10 or dirty laundry items can be arbitrary laundry items, preferably all kinds of items of clothing, also items of professional clothing.

Figure 1:
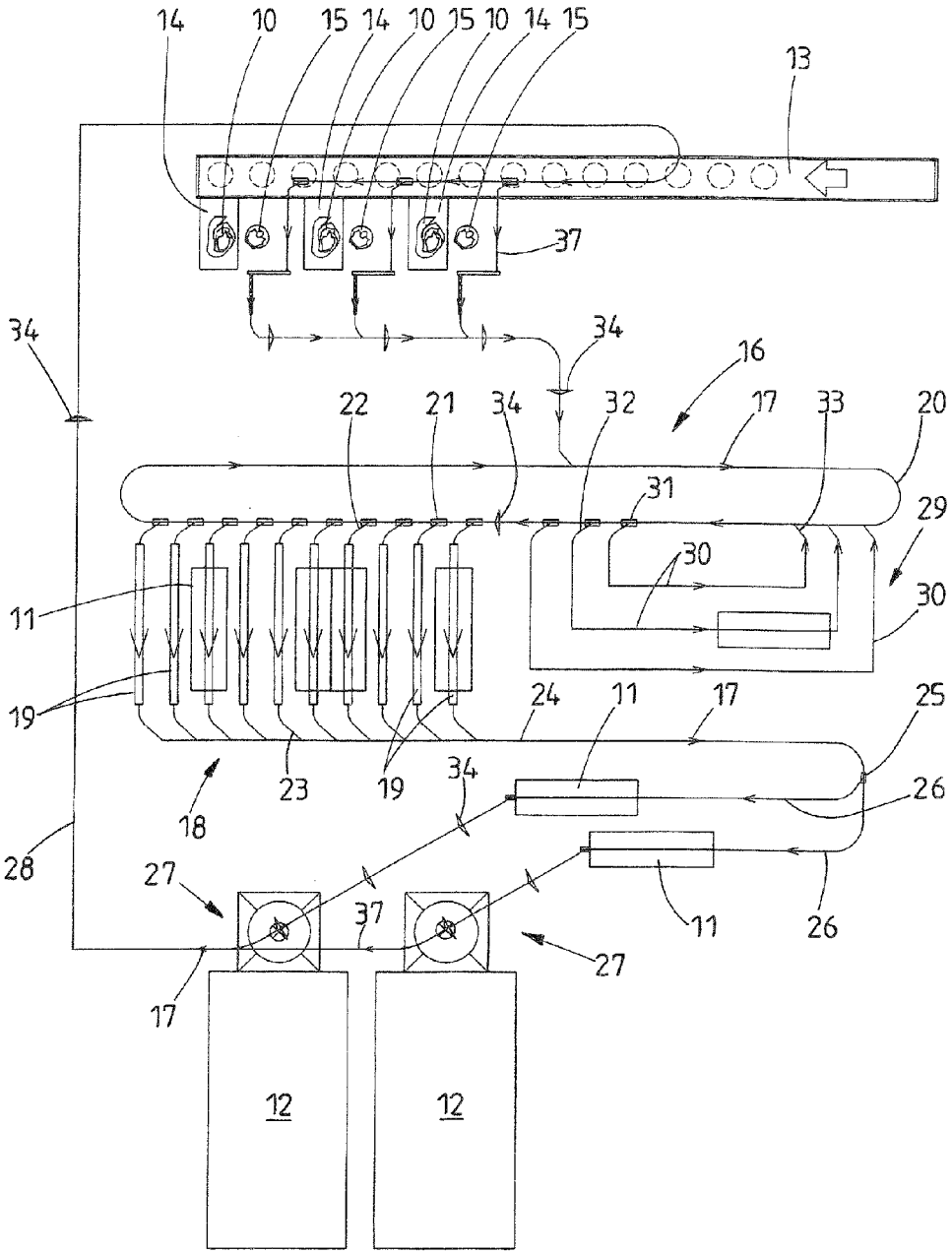
FIG. 1 shows a schematic plan view of a sorting system according to a first exemplary embodiment of the invention.

FIG. 1 shows an apparatus for sorting the laundry items 10, for at the same time forming laundry batches 11 from several laundry items 10 which meet the same sorting criteria and for supplying the laundry batches 11 to continuous-batch washing machines 12.

The laundry items 10 are conveyed as singles or in piles by a conveyor belt 13 or another continuous transporter to sorting tables 14 next to the conveyor belt 13. In the exemplary embodiment shown, three identically realized sorting tables 14 are provided next to the conveyor belt 13. Depending on the size of the sorting apparatus, more than or less than three sorting tables 14 can be provided. At least one operator 15 is situated at each sorting table 14. A conveying system 16 is provided between the sorting tables 14 and the continuous-batch washing machine 12. The conveying system 16 shown has a conveying section which runs in a loop. The conveying direction 17 of the conveying system 16 is symbolized by arrows.

The conveying system 16 in the exemplary embodiment shown is an overhead conveyor, below which the laundry items 10 can be forwarded in the conveying direction 17. The overhead conveyor can be formed in different ways. In a preferred manner, the overhead conveyor forming the conveying system 16 comprises a circulating conveying train, for example an endless conveying chain. Conveying hooks are arranged at regular spacings on the circulating conveying train—not shown in the schematic representations in the figures. However, the overhead conveyor of the conveying system 16 can also comprise a rail which extends along the conveying section and entrainment means spaced apart associated therewith, it being possible to move the entrainment means on in the transport direction 17 along the stationary rail.

A sorting device is provided between the sorting tables 14 and the continuous-batch washing machines 12. In the exemplary embodiment shown the sorting device is realized as a sorting storage means which comprises a storage means 18. The storage means 18 has several parallel storage sections 19 which function as sorting sections. The storage means 18 shown comprises ten storage sections 19 of the same length. The number of storage sections 19, however, is not restricted to ten. It is also conceivable to realize the storage sections 19 so as to be different. The storage means 18 is incorporated with the storage sections 19 in the conveying system 16 by each storage section 19 being formed by a portion of the conveying system 16.

A circular section 20 of the conveying system 16 is provided in the conveying direction 17 upstream of the storage sections 19. The circular section 20 leads past the inlet sides 22 of all the storage sections 19 and as a result is linked to the storage sections 19. The circular section 20 comprises a point 21 in the region of each storage section 19 on a (straight) portion leading past in front of the storage sections 19. The outlet sides 23 of all the storage sections 19 lead directly to a common removal portion 24 of the conveying system 16. The removal portion 24 is divided by means of a point 25 into two part portions 26 which branch at the point 25. Each part portion leads to one of the two continuous-batch washing machines 12, in the region of a loading point 27, for example a loading chute, of the respective continuous-batch washing machine 12. If more than two continuous-batch washing machines 12 are provided, more than two part portions 26 are provided, namely a part portion for each continuous-batch washing machine 12. In the case of only one single continuous-batch washing machine 12, the points 25 and the part portions 26 are not necessary. The removal portion 24 can then lead to the continuous-batch washing machine 12 without any branches. The conveying system 16 returns to the sorting tables 14 from the continuous-batch washing machines 12 by way of a return portion 28.

An intermediate storage means 29 is provided in the exemplary embodiment in FIG. 1. The intermediate storage means 29 serves for transferring out laundry items 10 where necessary upstream of the storage means 18 used for sorting. The intermediate storage means 29 has at least one intermediate storage section 30. There are three intermediate storage sections 30 in the exemplary embodiment shown. However, there can also be more or less. Each intermediate storage section 30 is connected by means of a point 31 to the portion of the circular section 20 leading past the intermediate storage section 30. The points 31 are situated on the inlet sides 32 of the intermediate storage sections 30. The outlet sides 33 of the intermediate storage sections 30 are returned again to the circular section 20. In this way, each intermediate storage section 30 forms its own circuit with a portion of the circular section 20 such that laundry items 10 can be conveyed back to the circular section 20 of the conveying system 16 along the respective intermediate storage section 30 upstream of the storage means 18. In the exemplary embodiment shown, the outlet sides 33 of the intermediate storage section 30 open out, when seen in the conveying direction 17, upstream of the points 31 of the circular section 20. As a result, it is possible to guide certain laundry items 10, where required, onto another intermediate storage section 30.

Figure 4:
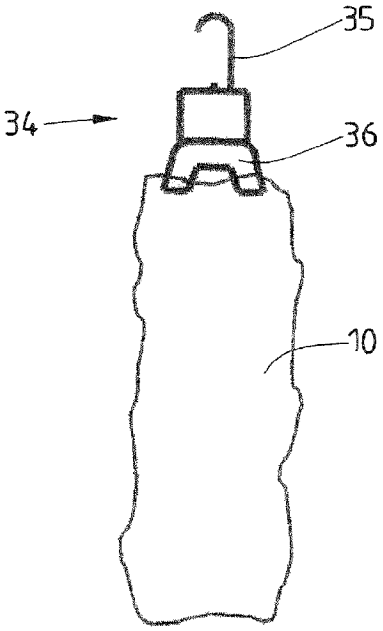
FIG. 4 shows a view of a laundry item hanging on the carrier.
Figure 3:
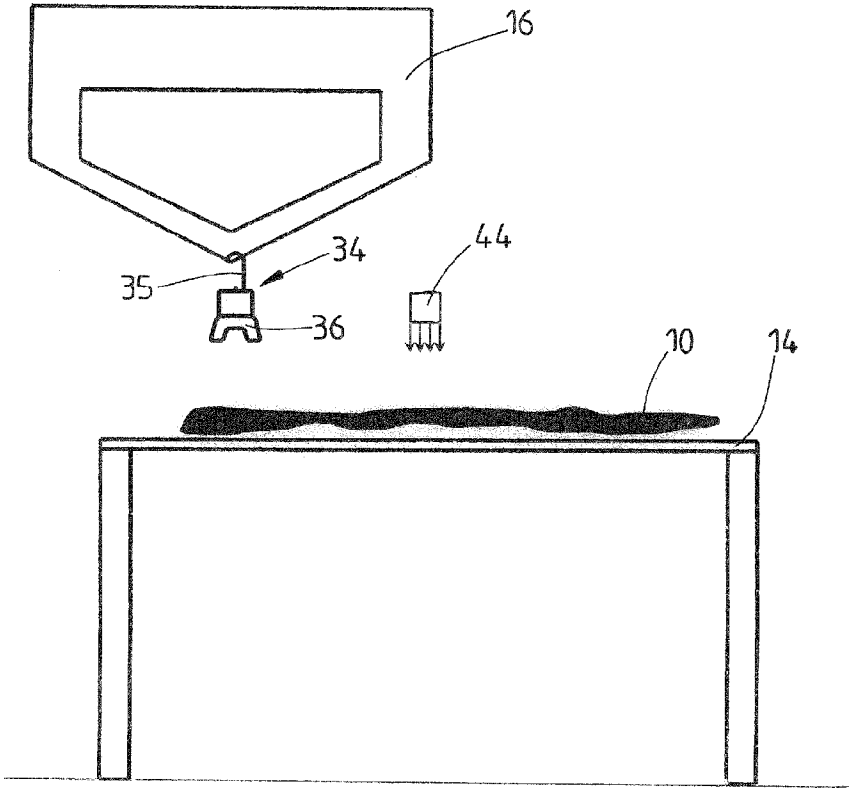
FIG. 3 shows an enlarged detail of the sorting system of FIGS. 1 and 2 in the region of the loading of a carrier with a laundry item.

Each carrying hook of the conveying system 16—not shown in the figure—has assigned thereto a carrier 34. All the carriers 34 are realized in an identical manner. The carriers 34 can be connected in an arbitrary manner to the carrying hook of the conveying system 16. In the exemplary embodiment shown (FIGS. 3 and 4) the carriers 34 are realized in the manner of clamping hangers. Such clamping hangers have an upper hook 35. Each carrier 34 is then suspended by its hook 35 on the carrying hooks of the conveying system 16, such that in each case a carrier 34 hangs below a carrying hook of the conveying system 16. Each of the carriers 34 shown here has on the bottom end a clamp 36 into which a top edge region of a laundry item 10 can be clamped. The laundry item 10 then hangs down freely from the respective carrier 34 below the conveying system 16.

Each carrier 34 has an information carrier—not shown in the figures—for information concerning that laundry item 10 which is assigned to the carrier 34 at that time, namely which hangs on the carrier 34. The information carrier, in a preferred manner, can be a data storage means, for example a chip. The information, namely data, concerning the laundry item 10 hanging on the carrier 34 is stored in the data storage means. Said data can be overwritten with information concerning the laundry item 10 which is to be assigned to the same carrier 34 as the next one. By means of a transmitting device in the region of each sorting table 14, the information is transmitted from the respective laundry item 10 to the chip or to another data carrier of precisely that carrier 34 on which the laundry item 10, to which the information belongs, has been suspended beforehand.

Read devices, which read off the information or data stored on the chips or another data carrier of the respective carrier 34, are situated along the conveying direction 17 and control or actuate the points 21, 25 or 31 correspondingly. Read devices can also be situated at other positions of the conveying system 16 such that wherever information concerning the respective laundry item 10 is required, it can also be read off.

The apparatus shown can comprise at least one inspection device—not shown in FIG. 1. The respective inspection device is situated, in a preferred manner, at the start of the conveying system 16, namely in the vicinity of the sorting tables 14. It is conceivable to assign a loading portion 37 of the conveying system 16 which leads past each sorting table 14 or close downstream thereof its own inspection device. The inspection devices are realized such that they detect the laundry item 10 hanging down freely from the respective carrier 34 in a contactless manner, in an image-generating manner by means of cameras and/or by means of sensors reacting to different materials or substances, for example metal detectors.

Figure 2:
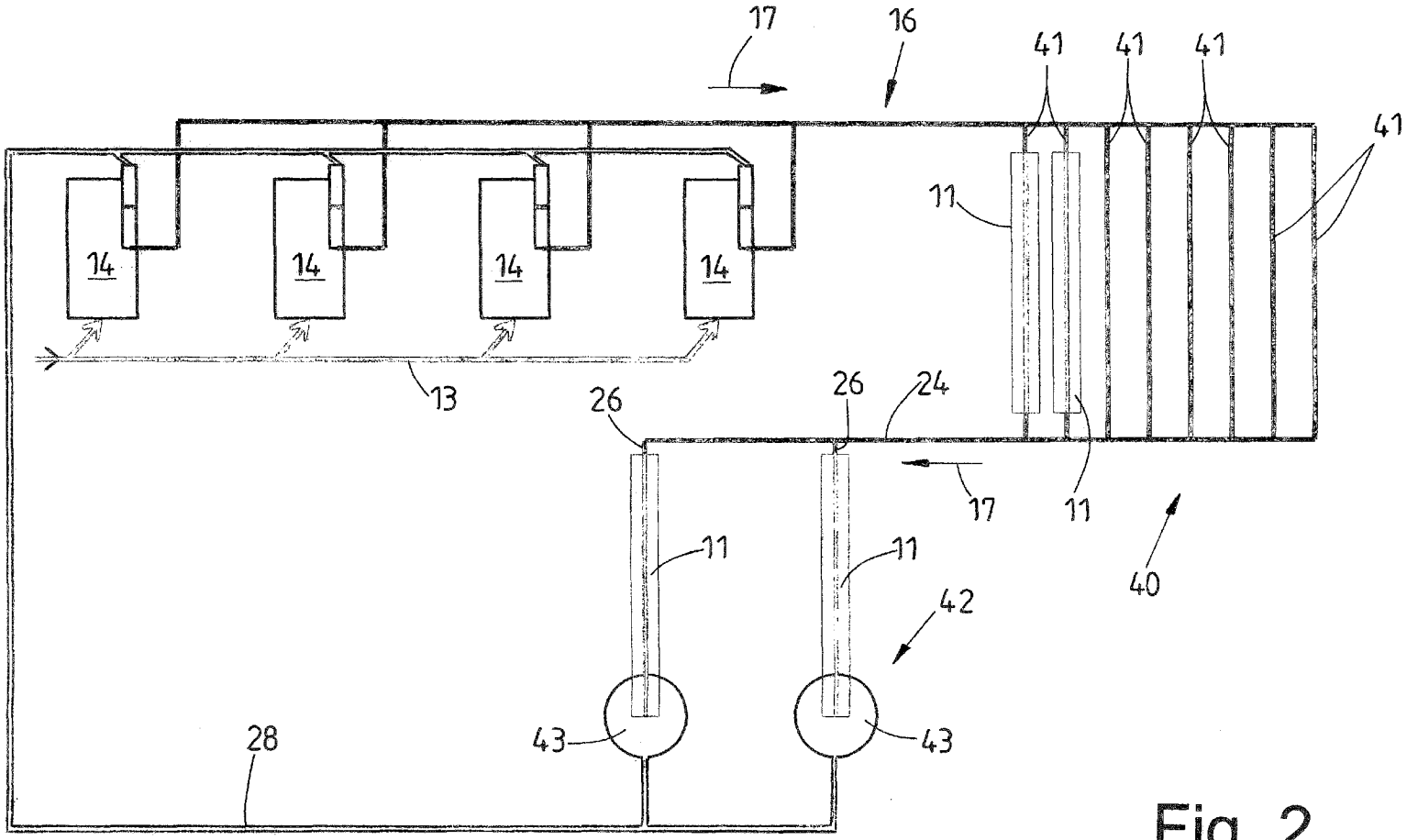
FIG. 2 shows a schematic plan view of a sorting system according to a second exemplary embodiment of the invention.

The exemplary embodiment shown in FIG. 2 differs from that in FIG. 1 essentially only in that there is no intermediate storage means 29 present and no continuous-batch washing machines 12 are loaded directly with a laundry batch 11 of sorted laundry items. Insofar as consistencies exist between the apparatuses in FIGS. 1 and 2, identical references are used for identical parts.

Because in the case of the exemplary embodiment in FIG. 2 there is no intermediate storage means 29 present, the storage means 40 serving as a sorting device comprises a sufficient number of parallel storage sections 41. In the exemplary embodiment shown, there are eight identical storage sections, if these are sufficient to sort all the laundry items 10. In the normal case, the number of storage sections 41 the apparatus has corresponds to the number of different sorting criteria.

The removal portion 24 of the conveying system 16 following the storage sections 41 of the storage means 40 in FIG. 2 conveys the laundry batches 11 to a so-called sack filling system 42. Here, the laundry items 10 of the laundry batch 11 are separated from the carriers 34 and are collected in a sack 43 or in another receiving container. Each sack 43 receives one sorted laundry batch 11. The respective laundry batch 11 is then movable in the sacks 43 to a treatment device in which the laundry items 10 of the laundry batch 11 are to be treated. In this connection, this can be finishing machines, chemical cleaning machines and/or any type of washing machine, where applicable also continuous-batch washing machines 12.

The methods according to the invention are described in more detail below with reference to the previously described apparatuses, in particular sorting systems. With the apparatus in FIG. 1, the method runs as follows:

Successive identical carriers 34 are conveyed at regular spacings in the circuit by the conveying system 16. Laundry items 10, dirty laundry items, are conveyed as singles or in piles of several laundry items 19 by the conveyor belt 13 to the sorting tables 14. At each sorting table 14, a laundry item 10 is removed from the conveyor belt by the relevant operator 15 and positioned on the sorting table 14 such that information can be read off an information carrier in or on the laundry item 10. For example, a label with a bar code which is read off by a corresponding reader is located on each laundry item 10. In this case, this can be a hand-held bar code reader which is produced by the operator 15 at the bar code of the laundry item 10 lying on the sorting table 14 to read off the information. However, it can also be a stationary bar code reader, under which the operator 15 holds the bar code of the laundry item 10 to read off the information concerning the same.

Once the data containing the information has been acquired, the information concerning the respective laundry item 10 read by the bar code reader or another data acquisition device is transmitted to the storage means of that carrier 34 in the clamp 36 of which the relevant laundry item 10 has been hung by the operator 15 and is stored there. The information belonging to the laundry item 10 it is holding at that time can be read at any time from the storage means of the carrier 34 at arbitrary positions of the conveying section of the conveying device 17. The data is available as a result during the entire conveying operation of the respective laundry item 10 along the conveying system 16 and can be read out everywhere in a complete or selective manner. Thus, a continuous tracing of the conveying path of the laundry item 10 through the conveying system 16 with the carrier 34 holding the same is guaranteed.

When an inspection apparatus is provided, the same is situated, in a preferred manner, in or directly downstream of the loading portion 37, it being possible to assign an inspection device to each sorting table 14. However, it is also conceivable to provide a common inspection device for all the sorting tables 14. Each laundry item 10 which is hanging down from the respective carrier 34 in a manner more or less spread out can be scanned in a contactless manner by the inspection device in order to detect faults, for example, holes, in the laundry item 10, but also large stains which require a possible special treatment and/or foreign bodies.

The information to be read out from the respective laundry item 10 is at least such that is necessary for the following treatment of the laundry item 10. For example, the wash program for the laundry item 10 to be washed, the weight of the laundry item 10 or at least an identification feature, for example concerning the origin or the owner of the laundry item 10 can be read off. However, this can also be information concerning the type of laundry item, the age or any other arbitrary information necessary for the treatment and follow-up treatment of the laundry items 10.

The carriers 14 with the laundry items 10 suspended thereon (a few carriers 34 are shown in FIG. 1 only by way of indication) are conveyed by the conveying system 16 in the conveying direction 17 to the storage means 18 which serves chiefly for sorting and/or the intermediate storage means 29. The circular section 20 of the conveying system 16 leads initially past the intermediate storage means 29 and then past the storage means 18. In good time upstream of the intermediate storage means 29, at least the wash program and the weight of the laundry item 10 suspended on the relevant carrier 34 are read out of the data storage means of each carrier 34. If it transpires that this is a laundry item 10 hanging on the carrier 34 which corresponds to the sorting criterion assigned to a storage section 19 of the storage means 18 serving as a sorting section, the carrier 34 and the laundry item 10 hanging thereon are conveyed past the intermediate storage means 29 directly to the storage means 18 and, as a result of automatic actuation of a point 21, the carrier 34 with the laundry item 10 are conveyed into that storage section 19, the sorting criterion of which is met by the laundry item 10. At the same time, the weight of the laundry item 10 conveyed into a certain storage section 19 is stored in a control means of the conveying system 16. Subsequent laundry items 10 which meet a different sorting criterion are automatically conveyed into the other storage section 19 reserved for this purpose.

If laundry items 10 with the same sorting criterion, in particular such which require the same wash program, are conveyed into the same storage section 19, the weights of the same are also deposited in the control means of the conveying system 16 and are added to the weights of the laundry items 10 already situated beforehand in the relevant storage section 19. As soon as an overall weight of all the laundry items 10 located at that time in a storage section 19 is produced which corresponds to the desired weight of the laundry batch 11 or is situated within a tolerance range, the now complete laundry batch 11 is conveyed out of the respective storage section 19 and is removed via the removal portion 24. The respective laundry batch 11 is then transferred by means of the point 25, actuated by the control means of the conveying system 16, into that part portion 26 which is free at that moment or will be the next one free. The laundry batch 11 is then conveyed along the relevant part portion 26 to the loading position 27 of the relevant continuous-batch washing machine 12. Here the laundry items 10 are gradually separated from their respective carriers 34, which is effected in a preferred manner by automatically opening the clamp 36. The, in each case, empty carrier 34 is then conveyed back to the sorting tables 14 via the return portion 28 of the conveying system 16. In this case, the information present in the chip of the respective carrier 34 concerning the laundry item 10 which has been separated from the carrier 34 at the continuous-batch washing machine 12 is erased. However, it is also conceivable for the information in the chip of the respective carrier 34 to be overwritten with the information concerning the next laundry item 10 suspended on the carrier 34 at the respective sorting table 14.

If on the data carrier of a carrier 34 information concerning the laundry item 10 hanging thereon is read out which does not correspond to any sorting criteria assigned at that moment to the storage sections 19, the laundry item 10 is conveyed with the relevant carrier 34 into the intermediate storage means 29. Here laundry items which comprise the same sorting criterion can be collected with the associated carriers 34 on the intermediate storage sections 30. Thus, where applicable, the laundry items 10 are pre-sorted in the intermediate storage means 29 on the respective storage sections 30 provided for that purpose. However, it is also conceivable to store laundry items 10 together with carriers 34 which meet different sorting criteria intermediately in each intermediate storage section 30, the procedure then preferably being such that certain sorting criteria are assigned to each intermediate storage section 30. When, for example, three sorting criteria are assigned in this way to one intermediate storage section 30, laundry items 10 together with carriers 34 which correspond to said three sorting criteria are transferred into the intermediate storage section 30 as a result of corresponding automatic actuation of the points 31. If the laundry items 10 provided for the intermediate storage means 29 comprise more than three different sorting criteria, but not only then, the laundry items 10, resorted, can also be moved into a free intermediate storage section 30 and stored there, resorted, in an intermediate manner.

If the intermediate storage means 29 comprises a certain number of laundry items 10 on carriers 34, it can be emptied by all or at least some of the laundry items 10 located on the same being transferred out with their carriers 34 such that they move onto the circular section 20 again. Said laundry items 10 are then conveyed onto at least one empty storage section 19. To this end, the control means of the conveying system 16 assigns the empty intermediate storage section 30 temporarily with another sorting criterion that is met by at least some of the laundry items 10 transferred out of the intermediate storage section 30. Thus, laundry items 10, sorted, from the intermediate storage means 28 are sorted into at least one storage section 19 of the storage means 18 provided for this purpose. If free storage sections 19 with the corresponding sorting criteria are not available in the storage means 18 for all the laundry items 10 comprising different sorting criteria from the intermediate storage section 30, laundry items 10 comprising the other sorting criteria continue to be conveyed with the carriers 34 in the circuit on the circular section 20 until storage sections 19, to which the sorting criterion of the laundry items 10 conveyed in the circuit can be assigned in a temporary manner, are free. As an alternative to this, it is also conceivable to convey those laundry items 10 with their carriers 34 which could still not be sorted in any storage section 19 back again on the circular section 20 into a suitable intermediate storage section 30 of the intermediate storage means 29.

By way of the information stored in the data storage means of the respective carrier 34 regarding the laundry items 10 hanging thereon, a control can be carried out in the region of each part portion 26 of the conveying system 16 upstream of the loading position 27 of each continuous-batch washing machine 12 as to whether the laundry items 10 of the laundry batch 11 provided for loading the continuous-batch washing machine 12 also correspond to the same sorting criterion, in particular are to be washed with the same wash program. The wash program read out upstream of the respective continuous-batch washing machine 12 can also be used for automatic control, namely wash program selection, of the continuous-batch washing machine 12 such that the washing program for the respective laundry batches 11 can be set automatically on the continuous-batch washing machine 12. Should it transpire that in the laundry batch 11 there is a laundry item 10 that should not or must not be washed with the wash program of the remaining laundry items 10 of the laundry batch 11, said laundry item with the associated carrier 34 can be transferred out upstream of the loading position 27 or the laundry item 10 is not separated from the carrier 34 at the loading position 27, but is conveyed past the loading position 27. Such a laundry item 10 is then conveyed back with the carrier 34 to the sorting tables 14 on the return portion 28 which is actually provided for empty carriers 34. Here, either the information concerning the laundry item 10 is scanned once again by the operator 15 and re-stored in the chip or the like of the carrier 34 or the carrier 34 with the laundry item 10 is once again supplied past the sorting table 14 by the conveying system 16 to the intermediate storage means 29 or the storage means 19.

The method with the sorting system in FIG. 2 runs in principle just as described beforehand. In the case of the sorting system in FIG. 2, however, there is no intermediate storing of such laundry items 10 with carriers 34 which do not meet any of the sorting criteria assigned at that moment to the storage sections 19. In the case of the method in FIG. 2, the storage means 40 consequently comprises a number of storage sections 41 which is sufficient for all occurring sorting criteria. The storage means 40 therefore has so many storage sections 41 that all the laundry items 10 meet a sorting criterion assigned to at least one storage section 41 such that in the case of said method intermediate storing of laundry items 10 with different sorting criteria is not necessary.

LIST OF REFERENCE NUMERALS

10 laundry item
11 laundry batch
12 continuous-batch washing machine
13 conveyor belt
14 sorting table
15 operator
16 conveying system
17 conveying direction
18 storage means
19 storage section
20 circular section
21 point
22 inlet side
23 outlet side
24 removal portion
25 point
26 part portion
27 loading point
28 return portion
29 intermediate storage means
30 intermediate storage section
31 point
32 inlet side

33 outlet side
34 carrier
35 hook
36 hanger
37 loading portion
40 storage means
41 storage section
42 sack filling system
43 sack
44 scanner

What is claimed is:

1. A method for sorting laundry items (10), comprising:

suspending the laundry items (10) on a conveying system;

conveying the laundry items (10) by the conveying system to at least one sorting device; and sorting the laundry items (10) in the at least one sorting device by way of information concerning the respective laundry item (10), wherein:

each laundry item (10) is suspended on a carrier (34) assigned to the conveying system (16);

the information concerning the laundry item (10) is transmitted to a data storage means assigned to the carrier (34);

the laundry item (10) with the carrier (34) assigned to it with the information concerning the laundry item (10) hanging on the carrier (34) is conveyed by the conveying system (16) to and/or through at least the at least one sorting device; and laundry batches (11) of the laundry items (10) are formed in the at least one sorting device by way of the information deposited in the data storage means of the carriers (34).

2. The method according to claim 1, wherein the information concerning the laundry item (10) is read before the laundry item (10) is suspended on the carrier (34) and said information is transmitted at least in part to the data storage means of that carrier (34) on which the laundry item (10) is suspended, and is stored there.

3. The method according to claim 1, wherein at least information concerning the customer, the weight, the wash program and/or possible special treatments of the laundry item (10) assigned to the carrier (34) is deposited in the storage means of the respective carrier (34).

4. The method according to claim 1, wherein, by way of the information in the data storage means of the carrier (34) which belong to the laundry item (10) assigned to the carrier (34), the laundry item (10) with the carrier (34) having this information in the data storage means is transported through the at least one sorting device.

5. The method according to claim 1, wherein the laundry batches (11) require a same treatment.

6. The method according to claim 1, wherein the laundry items (10) are supplied out of the at least one sorting device in batches with the carriers (34) to a treatment device and a check is carried out by way of the information in the data storage means of the carriers (34) as to whether the laundry items (10) can be assigned to the same laundry batches (11).

7. The method according to claim 6, wherein the laundry items (10) are separated from their carriers (34) upstream of the treatment device and the empty carriers (34) are conveyed back to receive the next laundry items (10), wherein the information concerning the previous laundry item (10) in the data storage means of the respective carrier (34) is erased or is overwritten with the information concerning the next laundry item (10) to be suspended on the respective carrier (34).

8. The method according to claim 6, wherein the treatment device is a washing machine or a finishing machine.

9. The method according to claim 6, wherein the check is carried out upstream of the treatment device.

10. The method according to claim 1, wherein the laundry items hanging down from the carriers (34) are moved by the conveying system (16) along or through a control station.

11. The method according to claim 10, wherein at the control station the laundry items (10) hanging down from the carriers (34) are individually scanned to determine any damage or faults in the laundry items (10) and/or foreign bodies in the laundry items (10).

12. The method according to claim 1, wherein the information concerning the laundry item (10) is manually scanned upstream of the suspending on the carrier (34) and said information is transmitted at least in part to the data storage means of that carrier (34) on which the laundry item (10) is suspended and is stored there.

13. The method according to claim 1, wherein the laundry items are dirty laundry items.

14. The method according to claim 1, wherein the laundry items (10) are conveyed by the conveying system (16) to the at least one sorting device, are sorted in storage sections (19) of the at least one sorting device, wherein laundry items (10) which meet the same sorting criteria are conveyed into the same storage section (19), and wherein laundry items (10) which do not meet any sorting criteria of the sorting sections (19) are initially intermediately stored.

15. The method according to claim 14, wherein after at least one of the storage sections (19) becomes free, the intermediately stored laundry items (11) are moved to the at least one free storage section (19) and laundry items sorted with the same sorting criteria are transferred into the relevant storage section (19).

16. The method according to claim 14, wherein a certain type of treatment is assigned to each of the storage sections (19) and, once a respective one of the storage sections (19) has been emptied, the type of treatment which is assigned to the respective storage section (19) can be changed into a type of treatment for at least some laundry items (10) in the intermediate storage means (29) in order to supply laundry items (10) out of the intermediate storage means (29) in a sorted manner to at least one of the respective storage sections (19) of the storage means (18) which meets the sorting criteria of the at least some laundry items (10) in the intermediate storage means (29).

17. The method according to claim 16, wherein the certain type of treatment is a wash program or a finishing treatment.

18. The method according to claim 14, wherein a certain type of treatment is assigned temporarily to each of the storage sections (19) and, once a respective one of the storage sections (19) has been emptied, the type of treatment which is assigned to the respective storage section (19) can be changed into a type of treatment for at least some laundry items (10) in the intermediate storage means (29) in order to supply laundry items (10) out of the intermediate storage means (29) in a sorted manner to at least one of the respective storage sections (19) of the storage means (18) which meets the sorting criteria of the at least some laundry items (10) in the intermediate storage means (29).

19. The method according to claim 18, wherein the certain type of treatment is a wash program or a finishing treatment.

20. The method according to claim 14, wherein the weight of all the laundry items (11) in the respective storage section (19) is determined.

21. The method according to claim 14, wherein when laundry items (10) are assigned in a sorted manner to the corresponding storage section (19), the weight of the laundry items is accumulated and as a result the overall weight of all the laundry items (10) of a laundry batch (11) in the respective storage section (19) is determined.

22. The method according to claim 21, wherein the weight of the respective laundry item (10) is read from a data storage means of the carrier (34) holding the respective laundry item (10).

23. The method according to claim 14, wherein the laundry items are dirty laundry items.

* * * * *